US008641246B2

(12) United States Patent
Takahara et al.

(10) Patent No.: US 8,641,246 B2
(45) Date of Patent: Feb. 4, 2014

(54) LAMP UNIT AND LIGHTING FIXTURE

(75) Inventors: Yuichiro Takahara, Yokosuka (JP); Shigeru Osawa, Yokosuka (JP); Takeshi Osada, Yokosuka (JP); Toshifumi Masuda, Yokosuka (JP); Hiromichi Nakajima, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 0 days.

(21) Appl. No.: 13/298,490

(22) Filed: Nov. 17, 2011

(65) Prior Publication Data

US 2012/0127739 A1 May 24, 2012

(30) Foreign Application Priority Data

Nov. 18, 2010 (JP) ..... 2010-258055

(51) Int. Cl.
*F21V 29/00* (2006.01)
*F21V 15/00* (2006.01)

(52) U.S. Cl.
USPC ..... 362/373; 362/362

(58) Field of Classification Search
USPC ..... 362/373, 294, 362, 311.06, 311.11, 362/311.09
See application file for complete search history.

(56) References Cited

U.S. PATENT DOCUMENTS

| | | | | |
|---|---|---|---|---|
| 4,858,071 | A | 8/1989 | Manabe | |
| 5,593,223 | A | 1/1997 | Koizumi | |
| 2006/0002104 | A1 | 1/2006 | Willis et al. | |
| 2007/0230194 | A1 | 10/2007 | Vilarrasa | |
| 2007/0279921 | A1 | 12/2007 | Alexander | |
| 2008/0123341 | A1 | 5/2008 | Chiu | |
| 2009/0213595 | A1 | 8/2009 | Alexander et al. | |
| 2010/0135000 | A1 | 6/2010 | Smith | |
| 2010/0186937 | A1* | 7/2010 | Liang | 165/185 |
| 2011/0261572 | A1* | 10/2011 | Watanabe et al. | 362/373 |
| 2011/0273895 | A1* | 11/2011 | Uemoto et al. | 362/430 |
| 2012/0127741 | A1 | 5/2012 | Osada et al. | |

FOREIGN PATENT DOCUMENTS

| | | | |
|---|---|---|---|
| CN | 1074824 | 11/2001 | |
| EP | 1840450 | 10/2007 | |
| EP | 1950491 A1 * | 7/2008 | F21V 29/00 |
| EP | 2543919 | 1/2013 | |
| JP | 2010-015798 | 1/2010 | |
| JP | 2010-192337 | 9/2010 | |
| JP | 2010-198807 | 9/2010 | |
| WO | WO 2008/124701 | 10/2008 | |

OTHER PUBLICATIONS

English Language Abstract of JP 2010-192337 published Sep. 2, 2010.

(Continued)

*Primary Examiner* — Anh Mai
*Assistant Examiner* — Elmito Breval
(74) *Attorney, Agent, or Firm* — DLA Piper LLP (US)

(57) ABSTRACT

According to one embodiment, a lamp unit includes a light-emitting module, a lighting circuit, and a housing. The light-emitting module includes a light emitting portion having a semiconductor light-emitting element. The lighting circuit lights the semiconductor light-emitting element. The housing includes a case opening in the direction of irradiation of light, and a base on a side of the case opposite from the direction of radiation of the light. The lighting circuit is accommodated in the case, and the light-emitting module is mounted on the base at a position closer to the base with respect to the position of the lighting circuit.

10 Claims, 8 Drawing Sheets

(56) References Cited

OTHER PUBLICATIONS

English Language Translation of JP 2010-192337 published Sep. 2, 2010.
U.S. Appl. No. 13/298,899.
Extended European Search Report issued in EP 11189641 on Jan. 30, 2013.
English Language Abstract of JP 2010-015798 published Jan. 21, 2010.
English Language Translation of JP 2010-015798 published Jan. 21, 2010.
English Language Abstract of JP 2010-198807 published Sep. 9, 2010.
English Language Translation of JP 2010-198807 published Sep. 9, 2010.
European Office Action issued in EP 11189641.1 on Nov. 13, 2013.
Chinese Office Action issued in 201110363665.3 dated Nov. 8, 2013.
English Language Translation of Chinese Office Action issued in 201110363665.3 dated Nov. 8, 2013.
English Language Abstract of CN 1074824 published on Nov. 14, 2001.

* cited by examiner

LAMP UNIT AND LIGHTING FIXTURE

INCORPORATION BY REFERENCE

The present invention claims priority under 35 U.S.C. §119 to Japanese Patent Application No. 2010-258055 filed on Nov. 18, 2010. The content of the application is incorporated herein by reference in its entirety.

FIELD

An embodiment of the present invention relates to a lamp unit using a semiconductor light-emitting element and a lighting fixture using this lamp unit.

BACKGROUND

In the related art, there are flat-type lamp units using a GX53-type base. The lamp unit of this type includes a metallic base member, and a light-emitting module having a semiconductor light-emitting element mounted on one surface of the base member, a transmissive cover mounted so as to cover the light-emitting module, the GX53-type base having a pair of lamp pins projected therefrom and mounted on the other surface of the base member, and a lighting circuit accommodated in the base.

However, in the case of such a lamp unit, when increasing a light output using the light-emitting module using large making power, the amount of heat generation of the light-emitting module is increased correspondingly. Therefore, an improvement of radiating performance from the lamp unit is necessary.

In order to improve the radiating performance from the lamp unit, it is conceivable to improve efficiency of heat conduction from the base of the lamp unit toward a lighting fixture with the lamp unit mounted on the lighting fixture. However, with the structure of the lamp unit of the related art, since the base member is interposed between the light-emitting module and the base, efficient conduction of heat from the light-emitting module to the base is not achieved, so that sufficient radiating performance can hardly be obtained.

Also, in order to bring the light-emitting module and the base into contact with each other, part to come into contact with the light-emitting module needs to be projected significantly from the one surface of the base. Consequently, there arises a problem in that the amount of used material of the base is increased, and the mass is increased correspondingly.

It is an object of the invention to provide a lamp unit in which radiating performance is improved while inhibiting an increase in amount of used material and an increase in mass, and a lighting fixture using this lamp unit.

BRIEF DESCRIPTION OF THE DRAWINGS

FIG. 5(*b*) is a cross-sectional view of the part of the heat conductive sheet of the lamp unit according to the first embodiment with the lamp unit mounted on the lighting fixture;

DETAILED DESCRIPTION

A lamp unit according to an embodiment includes a light-emitting module, a lighting circuit, and a housing. The light-emitting module has a semiconductor light-emitting element. The lighting circuit lights the semiconductor light-emitting element. The housing includes a case opening toward the direction of irradiation of light, and a base on the side of the case opposite from the direction of irradiation of light. The lighting circuit is accommodated in the case, and the light-emitting module is mounted on the base at a position close to the base than to the position of the lighting circuit.

Since the lighting circuit is accommodated in the case of the housing and the light-emitting module is mounted on the base at the position close to the base than to the position of the lighting circuit, heat of the light-emitting module can be conducted efficiently to the base and radiating performance from the base is improved and, furthermore, owing to the arrangement of the light-emitting module, part of the base to which the light-emitting module is mounted does not have to project significantly toward the case, so that increase in amount of material used for the base and increase in mass of the base can be inhibited.

Referring now to FIG. 1 to FIG. 7, a first embodiment will be described.

Figure 6:
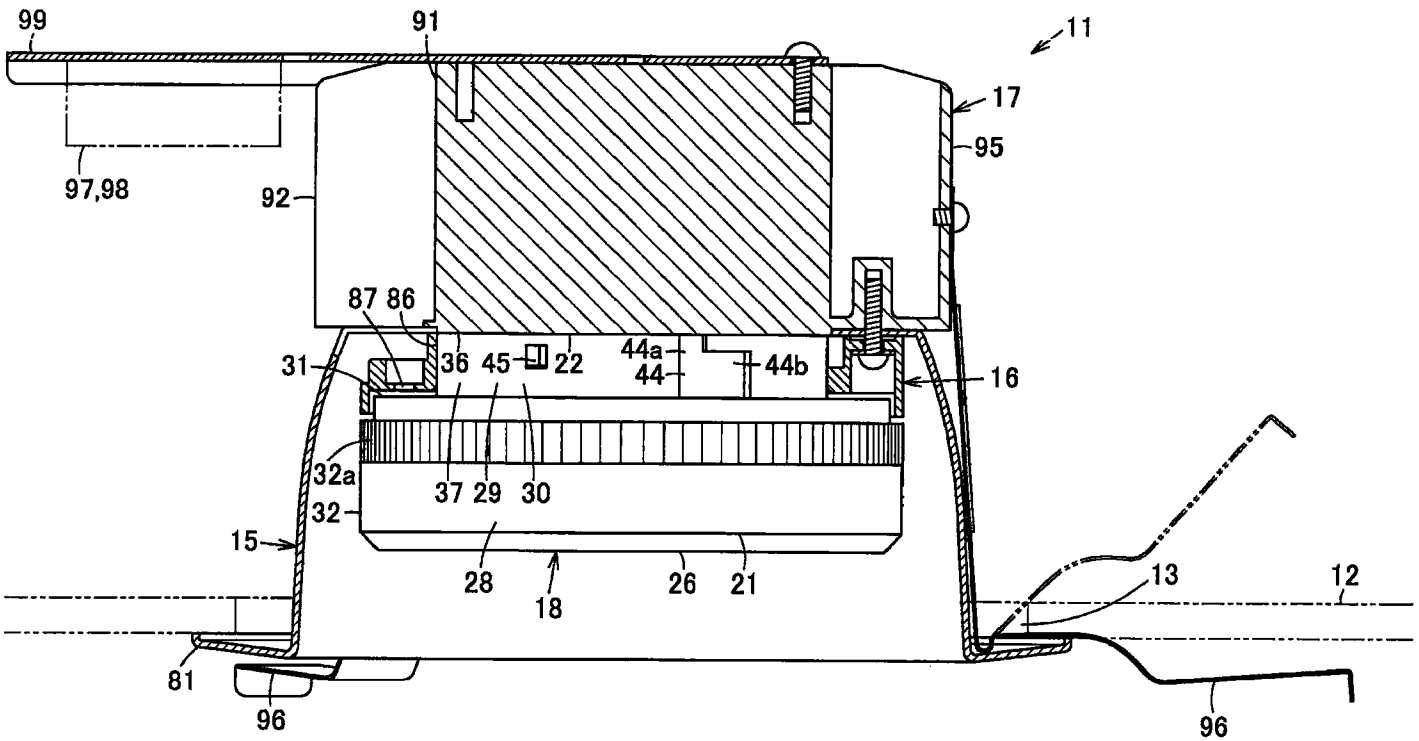
FIG. 6 is a cross-sectional view of the lighting fixture using the lamp unit according to the first embodiment.
Figure 7:
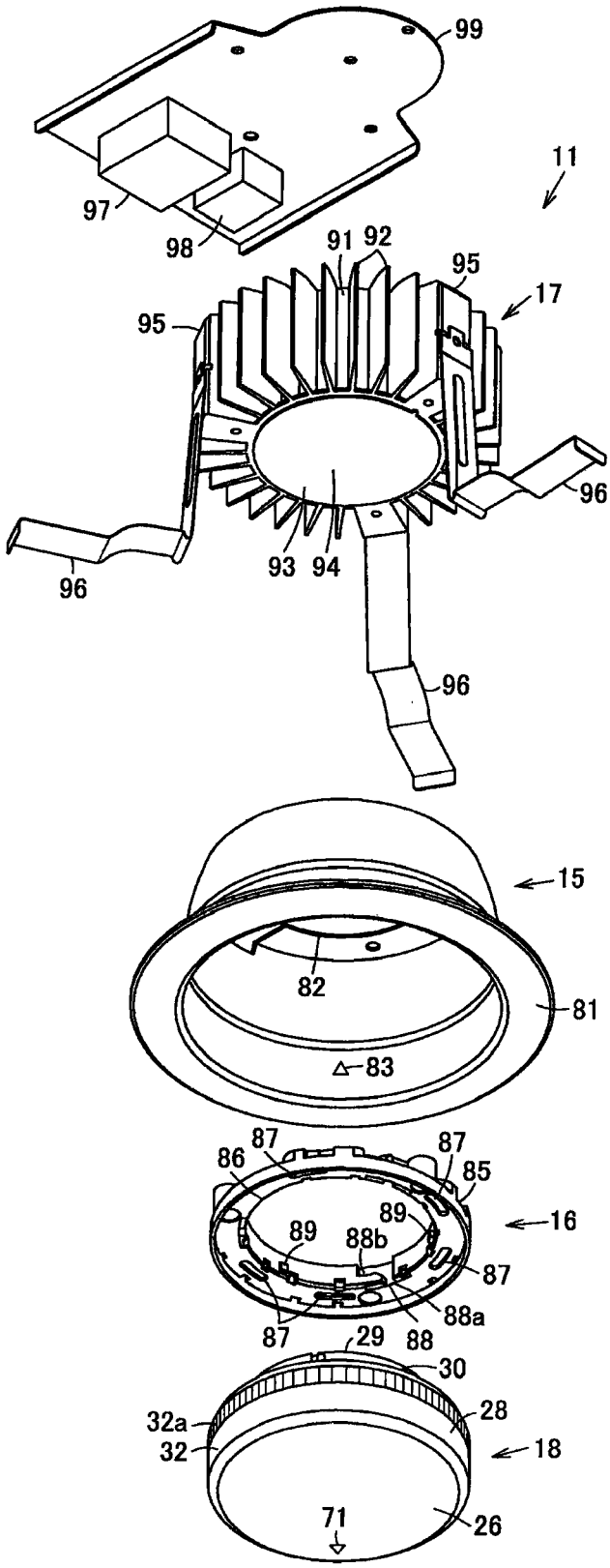
FIG. 7 is an exploded perspective view of the lamp unit according to the first embodiment.

As shown in FIG. 6 and FIG. 7, a lighting fixture 11 is an embedding-type lighting fixture such as a downlight, and is installed in a state of being embedded into a circular embedding hole 13 provided in a portion to be installed 12 such as a ceiling panel.

The lighting fixture 11 includes a fixture body 15, a socket 16 and a radiating member 17 integrally fixed to the fixture body 15, and a flat-type lamp unit 18 to be demountably mounted to the socket 16.

In the following description, with the lighting fixture 11 installed horizontally and the flat-type lamp unit 18 mounted on the lighting fixture 11 horizontally, a direction of irradiation of light, which is one side of the lamp unit 18, is defined as "lower" (for example, lower surface, lower side, lower portion, lower end, etc.), a direction opposite from the irradiation of light, which is the other side, is defined as "upper" (for example, upper surface, upper side, upper portion, upper end, etc.).

First of all, as shown in FIG. 1 to FIG. 5, the lamp unit 18 includes a flat-shaped cylindrical housing 21, a heat conductive sheet 22 mounted on an upper surface of the housing 21, a light-emitting module 23, a light control unit 24, and a lighting circuit 25 accommodated in the housing 21, and a glove 26 mounted on a lower surface of the housing 21.

The housing 21 includes a cylindrical case 28 and a cylindrical base member 29 to be mounted on an upper surface of the case 28. A base 30 is configured with an upper surface side of the case 28 and the base member 29 projecting from the upper surface of the case 28.

The case 28 is formed, for example, of a synthetic resin having insulating properties and includes a flat panel portion 31 on the upper surface and a peripheral surface portion 32 projecting downward from a peripheral portion of the flat panel portion 31. The flat panel portion 31 is formed with a through-hole 33 at a center thereof, a plurality of mounting holes 34 radially outside of the through-hole 33, and a plurality of insertion holes 35 on the radially outside of the mounting holes 34. A patterned indented portion 32*a* is formed on an outer peripheral surface of the peripheral surface portion 32 on the side of an upper portion thereof for increasing the surface area.

The base member 29 is formed of a material selected from a group of metals such as aluminum die-cast, ceramics, or resins superior in heat conductivity, and includes an end surface 36 as a base surface on an upper surface (an outer surface opposite from the side of the case), and a peripheral surface portion 37 projecting downward from the periphery of the end surface 36. Formed inside the peripheral surface portion 37 are a plurality of bosses 39 which allow a plurality of screws 38 used for fixing the case 28 with the base member 29 to be screwed therein via the plurality of the mounting holes 34 of the case 28.

Formed integrally with a lower surface of the end surface 36 (the surface on the side of the case) at the center thereof is a heat conducting portion 40 projecting toward the case 28, the heat conducting portion 40 is formed with a flat-shaped mounting surface 41 for mounting the light-emitting module 23 on a lower surface thereof, and the mounting surface 41 is formed with a plurality of mounting holes 42. The heat conducting portion 40 is formed to be thicker than other portion of the base member 29. An annular restricting portion 43 is formed on a peripheral portion of the end surface 36 so as to project therefrom and a depressed portion 30*a* for positioning and mounting the heat conductive sheet 22 is formed inside the restricting portion 43.

Formed on the peripheral surface portion 37 are a plurality of key grooves 44. Each of the key grooves 44 is formed into a substantially L-shape including a vertical groove 44*a* formed along the vertical direction so as to continue to the upper surface of the base member 29 and a lateral groove 44*b* formed on a lower portion of the peripheral surface portion 37 in the circumferential direction of the peripheral surface portion 37. In addition, the peripheral surface portion 37 is formed with a plurality of keys 45 at positions between the adjacent key grooves 44 and lower than the position of the end surface 36 so as to project therefrom as socket mounting portions. Although three each of the key grooves 44 and the keys 45 are provided in this embodiment, at least two each of them are necessary and four each or more of those may also be provided.

Figure 1:
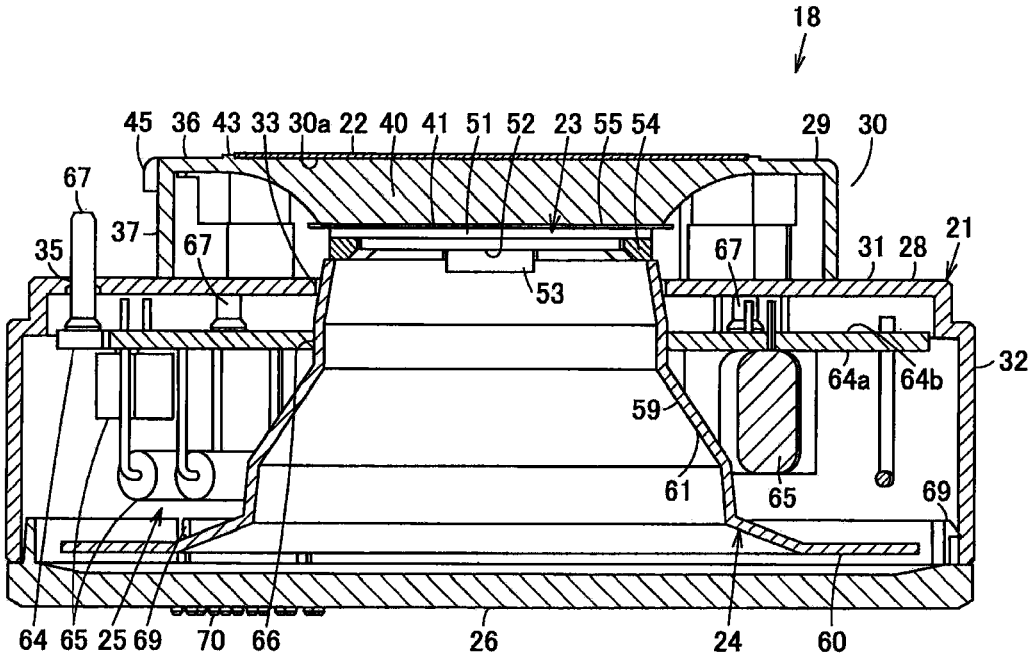
FIG. 1 is a cross-sectional view of a lamp unit according to a first embodiment.
Figure 2:
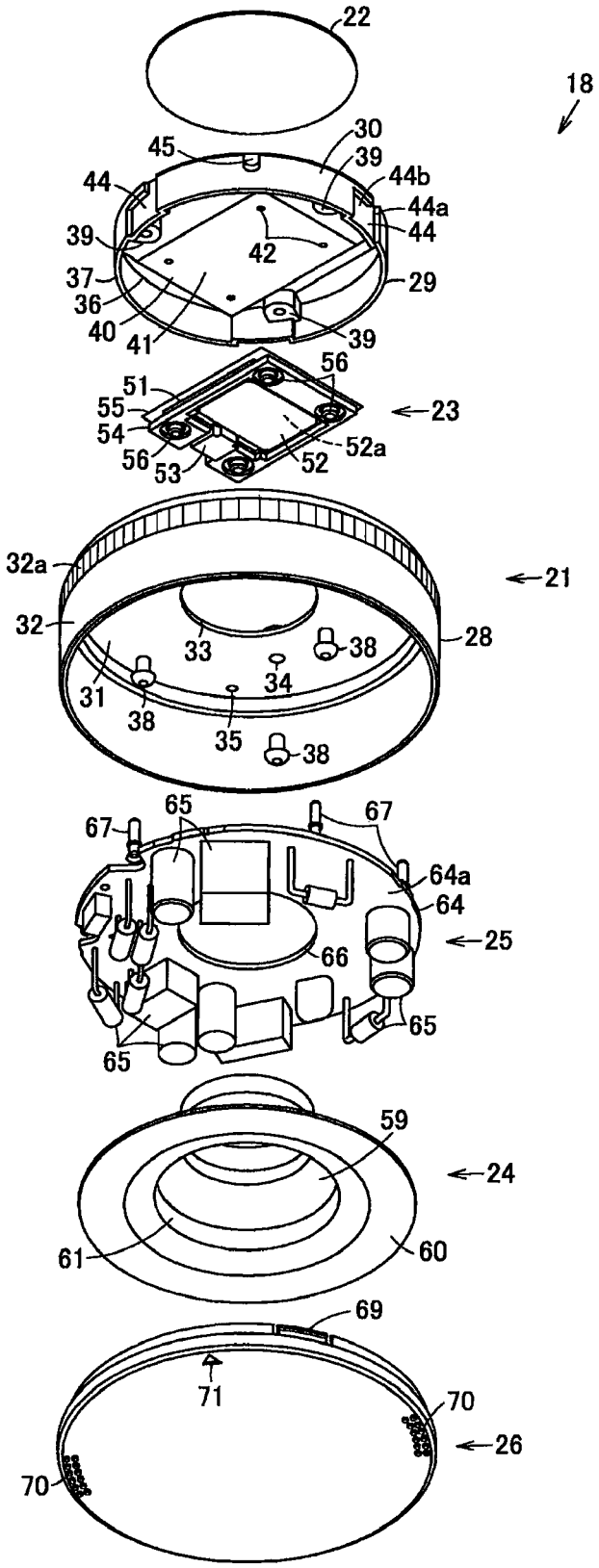
FIG. 2 is an exploded perspective view of the lamp unit according to the first embodiment.
Figure 3:
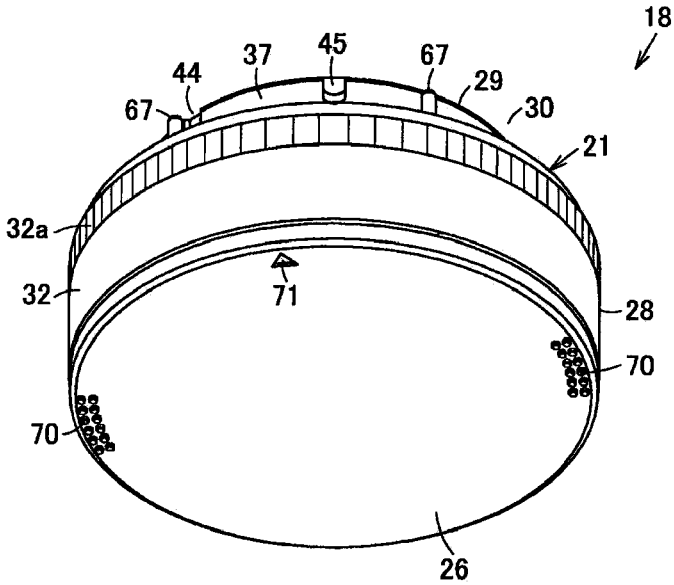
FIG. 3 is a perspective view of one surface of the lamp unit according to the first embodiment.
Figure 4:
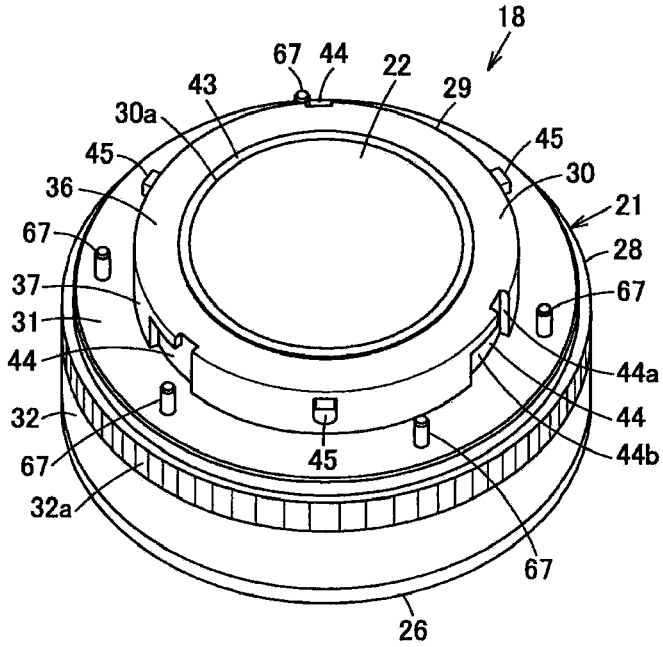
FIG. 4 is a perspective view of the other surface of the lamp unit according to the first embodiment.
Figure 5:
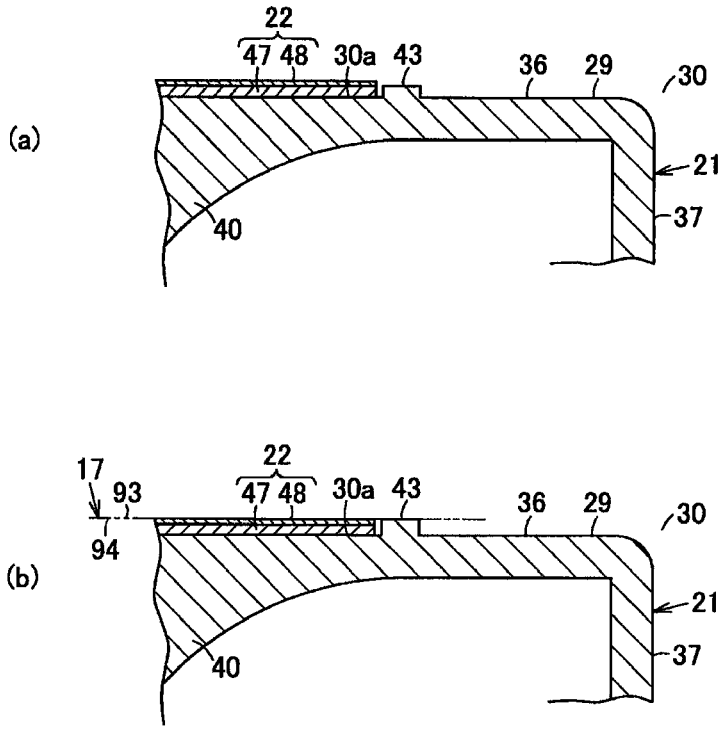
FIG. 5(*a*) is a cross-sectional view of part of a heat conductive sheet of the lamp unit according to the first embodiment, before the lamp unit is mounted on a lighting fixture.

The heat conductive sheet 22 is configured to be brought into intimate contact with the radiating member 17 if the lamp unit 18 is mounted on the lighting fixture 11 and conduct heat from the lamp unit 18 to the radiating member 17 efficiently. As shown in FIG. 5, the heat conductive sheet 22 is formed into a disk shape and includes a silicone sheet 47 having resiliency and adhered to the end surface 36 inside the restricting portion 43 of the base member 29 and a metal foil 48 such as aluminum, tin, or zinc to be adhered to an upper surface of the silicone sheet 47. A frictional resistance of the surface of the metal foil 48 is smaller than that of the silicone sheet 47.

As shown in FIG. 5(*a*), if the lamp unit 18 is not mounted on the lighting fixture 11 and no pressure is applied on the heat conductive sheet 22, the projecting dimension of the heat conductive sheet 22 from the end surface 36 of the base member 29 is larger than the height of the restricting portion 43. As shown in FIG. 5(*b*), if the lamp unit 18 is mounted on the lighting fixture 11, the heat conductive sheet 22 is pressed against the radiating member 17, and a pressure is applied to the heat conductive sheet 22, the heat conductive sheet 22 (the silicone sheet 47) can be compressed within a range of resilient deformation thereof until the projecting dimension of the heat conductive sheet 22 from the end surface 36 of the base member 29 becomes the same as the height of the restricting portion 43.

The light-emitting module 23 includes a substrate 51, a light-emitting portion 52 formed on a lower surface of the substrate 51, a connector 53 mounted on the lower surface of the substrate 51, a frame-shaped holder 54 configured to hold the periphery of the substrate 51, and a heat conductive sheet 55 interposed between the substrate 51 and the mounting surface 41 of the heat conducting portion 40 of the base member 29 where the substrate 51 is to be mounted.

The substrate 51 is formed of a material such as a metal or ceramics superior in heat conductivity into a flat panel shape.

The light-emitting portion 52 employs a semiconductor light-emitting element 52*a* such as an LED element or an EL element as a light source. In this embodiment, LED elements are employed as the semiconductor light-emitting element 52*a*, and a COB (Chip On Board) system in which a plurality of the LED elements are mounted on a substrate is employed. In other words, the plurality of the LED elements are mounted on the substrate, and the plurality of the LED elements are electrically connected in series by wire bonding, and the plurality of the LED elements are integrally covered and sealed with a fluorescent material layer, which is a transparent resin such as a silicone resin having a fluorescent material mixed thereto. For example, LED elements emitting blue light are employed as the LED elements, and the fluorescent material which emits yellow light by being pumped by part of the blue light from the LED elements is mixed to the fluorescent material layer. Therefore, the light-emitting portion 52 is composed of the LED elements and the fluorescent material layer, and the surface of the fluorescent material layer, which is the surface of the light-emitting portion 52 serves as a light-emitting surface, and white illuminating light is radiated from the light-emitting surface. As the light-emitting portion, a system of mounting a plurality of SMD (Surface Mount Device) packages with connecting terminals having the LED elements mounted thereon on the substrate may be employed.

The connector 53 is electrically connected to the LED elements.

The holder 54 holds the substrate 51, and is fixed in a state of sandwiching the heat conductive sheet 55 and the substrate 51 with respect to the heat conducting portion 40 of the base member 29 with a plurality of screws 56 screwed into a plurality of the mounting holes 42 on the heat conducting portion 40 of the base member 29. Accordingly, the substrate 51 is brought into intimate contact with the heat conducting portion 40 of the base member 29 via the heat conductive sheet 55, so that satisfactory heat conductivity from the substrate 51 to the base member 29 is ensured.

The heat conductive sheet 55 may be a metal foil such as aluminum, tin, or zinc instead of the silicone sheet. By using the metal foil, deterioration due to heat is less serious than the silicone sheet, so that the heat conducting performance can be maintained for a long term.

The light control unit 24 is formed of a cylindrical reflecting member. The light control unit 24 is formed of, for example, a synthetic resin having insulating properties, includes a cylindrical light guide portion 59 broadened step by step or continuously from an upper end side toward a lower end side, and an annular cover portion 60 formed at a lower end of the light guide portion 59 so as to cover the periphery of a lower surface of the case 28. Formed on an inner surface of the light guide portion 59 and a lower surface of the cover portion 60 is a reflecting surface 61 having a high optical reflectance in white or having mirror surface. An upper end of the light guide portion 59 projects into the base member 29 through the through-hole 33 of the case 28, and is held by the holder 54 of the light-emitting module 23 in abutment. Therefore, the light-emitting module 23 and the lighting circuit 25 are separated by the light control unit 24. The light control unit 24 may be a lens, or may be a combination of a reflecting member and a lens.

The lighting circuit 25 configures a power circuit configured to rectify and smooth a commercial power supply voltage and output a constant-current DC power, and includes a lighting circuit board 64 and lighting circuit components 65, which are a plurality of electronic components mounted on the lighting circuit board 64. The lighting circuit 25 is accommodated and mounted in the case 28 formed of an insulating material.

The lighting circuit board 64 is formed into an annular shape having a circular opening 66 for allowing penetration of the light control unit 24 at a center portion thereof. A lower surface of the lighting circuit board 64 is a mounting surface 64*a* for mounting discrete components having a lead wire from among the lighting circuit components 65, and an upper surface is a wiring pattern surface 64*b* formed with a wiring pattern for connecting the lead wires of the discrete components and mounting the surface mounting components from among lighting circuit components.

Among the lighting circuit components 65 to be mounted on the mounting surface 64*a* of the lighting circuit board 64, at least one, preferably all, of large components having a large projecting height from the lighting circuit board 64, heat generating components with high calorific value, and components having a low tolerance for heat such as an electrolytic capacitor are mounted at outer positions of the lighting circuit board 64. The components having a low tolerance for heat such as the electrolytic capacitor are mounted at positions away from the light guide portion 59 of the light control unit 24 on the lighting circuit board 64. The annular lighting circuit board 64 includes components which may generate a noise such as a switching element mounted at positions away and opposite from the position of the power supply input portion in terms of the circumferential direction.

The lighting circuit board 64 is arranged on an upper side in the case 28 in a state in which the wiring pattern surface 64*b* opposes an inner surface of the flat panel portion 31 of the case 28 in parallel. The lighting circuit components 65 mounted on the mounting surface 64*a* of the lighting circuit board 64 are arranged between the peripheral surface portion 32 of the case 28 and the light guide portion 59 and the cover portion 60 of the light control unit 24.

Provided so as to project vertically from a peripheral portion of the wiring pattern surface 64*b* of the lighting circuit board 64 are a plurality of lamp pins 67 electrically connected to the wiring pattern. The plurality of the lamp pins 67 include two lamp pins 67 for the power supply, two lamp pins 67 for light control signals, and one lamp pin 67 for grounding. These lamp pins 67 are press-fitted into the respective insertion holes 35 of the case 28 and project vertically upward of the case 28. In other words, the plurality of the lamp pins 67 project vertically from an upper surface of the base 30.

For reference sake, at least two lamp pins 67 for the power supply are essential and other lamp pins 67 do not necessarily have to be provided. Alternatively, the lamp pins 67 may not be provided on the lighting circuit board 64 and dummy pins to be press-fitted and fixed into the insertion holes 35 of the case 28 may be provided.

Connected to an output terminal of a DC power supply of the lighting circuit 25 is wiring with a connector to be connected to the connector 53 of the light-emitting module 23.

The glove 26 is formed, for example, of a transmissive synthetic resin or glass, and is fitted into a lower portion of the peripheral surface portion 32 so as to cover the lower surface of the case 28, and is mounted on the case 28 with a plurality of claws 69 provided on a peripheral portion of the glove 26 being locked on the peripheral surface portion 32. In the peripheral portion of a lower surface of the glove 26, finger placing portions 70 including a plurality of projections are provided on a plurality of positions, for example, two positions, on a circumference of the glove 26 so as to be projected therefrom, and a triangle mark 71 indicating a mounting position with respect to the lighting fixture 11 is formed at one position. It is also possible to form a Fresnel lens which controls direction of irradiation of light from the light-emitting portion 52 through the glove 26, that is, distribution of light, on an inner surface of the glove 26 opposing the light-emitting portion 52 of the light-emitting module 23.

In the lamp unit 18 configured as described above, the lighting circuit 25 is arranged in the case 28, the light-emitting module 23 is arranged in the base member 29, which is a position on the side of the base 30 with respect to the position of the lighting circuit 25 in the case 28, and the light-emitting module 23 is mounted to the base member 29 by being thermally bonded. In addition, the light-emitting module 23 is arranged at an upper position closer to the end surface 36 of the base member 29 with respect to the position of the upper surface of the case 28. The light-emitting module 23 and the lighting circuit 25 are separated by the light control unit 24. The light guide portion 59 of the light control unit 24 is arranged in the opening 66 of the lighting circuit board 64 and in the through-hole 33 of the case 28, and the cover portion 60 of the light control unit 24 covers and shields the lighting circuit 25 in the case 28.

The input power (consumed power) and the total luminous flux of the light-emitting module 23 in the lamp unit 18 in this embodiment are 20 to 25 W and 1100 to 1650 lm, respectively.

Subsequently, as shown in FIG. 6 and FIG. 7, the fixture body 15 of the lighting fixture 11 is used also as a reflective member, and is formed so as to open downward. Formed at a lower end of the fixture body 15 is a flange portion 81 projecting sideward, and a fitting hole 82 is formed on an upper surface of the fixture body 15. Provided on an inner peripheral surface of the fixture body 15 at one position is a triangle mark 83 indicating a mounting position of the lamp unit 18.

The socket 16 includes a socket body 85 formed of a synthetic resin having insulating properties, for example, into an annular shape and a plurality of terminals, not shown, arranged in the socket body 85.

Formed at a center of the socket body 85 is an insertion opening 86 for allowing insertion of the base member 29 of the lamp unit 18. On a lower surface of the socket body 85, a plurality of connecting grooves 87, formed into an elongated hole, for allowing insertion of the respective lamp pins 67 of the lamp unit 18, are arranged in the circumferential direction.

Formed on an inner peripheral surface of the socket body 85 are a plurality of key grooves 88. Each of the key grooves 88 is formed into a substantially L-shape including a vertical groove 88*a* formed along the vertical direction and a lateral groove 88*b* formed on the side of an upper portion of the socket body 85 in the circumferential direction. In addition, formed on the inner peripheral surface of the socket body 85 between the plurality of the key grooves 88 so as to project therefrom are a plurality of keys 89. The key grooves 88 and the keys 89, and the keys 45 and the key grooves 44 of the lamp unit 18 correspond to each other respectively, so that the lamp unit 18 can be demountably mounted to the socket 16.

The respective terminals are arranged on an upper side of the respective connecting grooves 87, the lamp unit 18 is mounted in the socket 16, and the respective lamp pins 67 inserted into the respective connecting grooves 87 are electrically connected.

The radiating member 17 is formed of a material selected from a group of metals such as aluminum die-cast, ceramics, or resin superior in heat radiation. The radiating member 17 includes a cylindrical base portion 91 and a plurality of radiating fins 92 projecting radially from the periphery of the base portion 91.

Formed at a center portion of a lower surface of the base portion 91 is a circular projecting portion 93 closing the lower surface of the base portion 91, and a flat contact surface 94 is formed on a lower surface of the projecting portion 93.

A plurality of mounting portions 95 are formed on the periphery of the base portion 91 of the radiating member 17, and mounting springs 96 for mounting the lighting fixture 11 to the portion to be installed 12 are mounted to the mounting portions 95.

Mounted on an upper surface of the radiating member 17 are a mounting plate 99 having a terminal base 97 for the power supply and a terminal base 98 for the light control signals mounted thereon.

The lighting fixture 11 is fixed with screws with the fitting hole 82 of the fixture body 15 fitted around the projecting portion 93 of the radiating member 17, and the fixture body 15 sandwiched between the radiating member 17 and the socket 16. The contact surface 94 of the radiating member 17 is arranged so as to be exposed from an upper surface of the insertion opening 86 of the socket 16.

Subsequently, mounting of the lamp unit 18 on the lighting fixture 11 will be described.

The lamp unit 18 is inserted from an opening on the lower surface of the fixture body 15, the mark 71 indicated on the lamp unit 18 is aligned with the mark 83 indicated on an inner surface of the fixture body 15, and the lamp unit 18 is pushed upward so as to be inserted into the socket 16.

Accordingly, the base member 29 of the lamp unit 18 is fitted into the insertion opening 86 of the socket 16 first, then the respective keys 89 of the socket 16 enter the vertical grooves 44*a* of the respective key grooves 44 of the base member 29 and the respective keys 45 of the base member 29 enter the vertical grooves 88*a* of the respective key grooves 88 of the socket 16, the respective lamp pins 67 of the lamp unit 18 are inserted into the corresponding connecting grooves 87 of the socket 16 respectively, and then the upper surface of the base member 29 comes into abutment with the contact surface 94 of the radiating member 17 via the heat conductive sheet 22. At this time, since the heat conductive sheet 22 projects from the restricting portion 43 of the base member 29, firstly, the heat conductive sheet 22 comes into abutment with the contact surface 94 of the radiating member 17 and hence is compressed, and then the restricting portion 43 of the base member 29 comes into abutment with the contact surface 94 of the radiating member 17.

The lamp unit 18 is rotated in the mounting direction with the lamp unit 18 pushed against the radiating member 17. At this time, since the metal foil 48 is provided on the surface of the heat conductive sheet 22 and the metal foil 48 comes into contact with the contact surface 94 of the radiating member 17, the heat conductive sheet 22 can move easily and smoothly with respect to the contact surface 94 of the radiating member 17 in comparison with a case where the silicone sheet 47 is in direct contact with the contact surface 94 of the radiating member 17 for example, so that the rotational operation of the lamp unit 18 can be facilitated. In addition, since the restricting portion 43 comes into abutment with the contact surface 94 of the radiating member 17 to restrict further resilient deformation of the heat conductive sheet 22 and hence increase in pushing force that pushes the heat conductive sheet 22 against the contact surface 94 of the radiating member 17 is restricted, the heat conductive sheet 22 can move easily with respect to the contact surface 94 of the radiating member 17, so that the rotational operation of the lamp unit 18 can be facilitated.

When rotating the lamp unit 18, even if there is only a small space which allows insertion of fingers between a peripheral surface of the lamp unit 18 and the inner surface of the fixture body 15, the lamp unit 18 can easily be rotated by getting the fingers caught by the finger placing portions 70 projecting from the lower surface of the glove 26. If the fingers can be get caught by the glove 26, a plurality of depressed portions may be provided in the peripheral portion of the glove 26 instead of the finger placing portions 70.

By rotating the lamp unit 18 in the mounting direction, the respective keys 89 of the socket 16 enter and are caught by the lateral groove 44*b* of the respective key grooves 44 of the base member 29 and the respective keys 45 of the base member 29 enter and are caught by the lateral grooves 88*b* of the respective key grooves 88 of the socket 16, whereby the lamp unit 18 is mounted on the socket 16. The respective lamp pins 67 of the lamp unit 18 move in the respective connecting grooves 87 of the socket 16, and come to contact with and are electrically connected to the respective terminals arranged on the upper sides of the respective connecting grooves 87.

When the lamp unit 18 is mounted, the upper surface of the base member 29 of the lamp unit 18 comes into intimate contact with the contact surface 94 of the radiating member 17 via the heat conductive sheet 22, so that efficient heat conduction from the lamp unit 18 to the radiating member 17 is achieved.

When demounting the lamp unit 18 from the lighting fixture 11, first of all, the lamp unit 18 is rotated in the demounting direction, which is a direction opposite from the mounting direction, whereby the respective keys 89 of the socket 16 move to the vertical grooves 44*a* of the respective key grooves 44 of the base member 29 and the respective keys 45 of the base member 29 move to the vertical grooves 88*a* of the respective key grooves 88 of the socket 16, so that the respective lamp pins 67 move in the respective connecting grooves 87 of the respective socket 16 away from the respective terminals arranged on the upper side of the respective connecting grooves 87. Subsequently, by moving the lamp unit 18 downward, the respective lamp pins 67 come apart from the respective connecting grooves 87 of the respective socket 16, the vertical grooves 44*a* of the respective key grooves 44 of the base member 29 come apart from the respective keys 89 of the socket 16 and, simultaneously, the respective keys 45 of the base member 29 come apart from the vertical grooves 88*a* of the respective key grooves 88 of the socket 16, and then the base member 29 comes apart from the insertion opening 86 of the socket 16, so that the lamp unit 18 can be demounted from the socket 16.

Subsequently, lighting of the lamp unit 18 will be described.

If electricity is supplied from a power supply line to the lighting circuit 25 via the terminal base 97, the terminals of the socket 16, and the lamp pins 67 of the lamp unit 18, lighting power is supplied from the lighting circuit 25 to the LED elements of the light-emitting module 23, so that the LED elements is lit. Light radiated from the light-emitting portion 52 by lighting of the LED elements travels in the light guide portion 59 of the light control unit 24, passes through the glove 26, and is emitted from the opening on the lower surface of the fixture body 15.

When the LED elements are turned ON, heat that the LED elements of the light-emitting module 23 generate is mainly conducted efficiently from the substrate 51 of the light-emitting module 23 to the heat conducting portion 40 of the base member 29 bonded thermally thereto via the heat conductive sheet 55, is conducted efficiently from the heat conducting portion 40 of the base member 29 to the radiating member 17 being in intimate contact thereto via the heat conductive sheet 22, and is radiated into air from the surface of the radiating member 17 including the plurality of the radiating fins 92.

Part of the heat conducted from the lamp unit 18 to the radiating member 17 is conducted respectively to the fixture body 15, a plurality of the mounting springs 96 and the mounting plate 99, and is radiated into air also therefrom.

Heat that the lighting circuit 25 generates is conducted to the case 28 and the glove 26, and radiated into air from the surfaces of the case 28 and the glove 26.

According to the lamp unit 18 in this embodiment configured as described above, since the lighting circuit 25 is accommodated in the case 28 of the housing 21 and the light-emitting module 23 is mounted on the base member 29 at the position above the position of the lighting circuit 25 in the case 28, heat of the light-emitting module 23 can be conducted efficiently to the base member 29 and radiating performance from the base member 29 is improved and, furthermore, owing to the arrangement of the light-emitting module 23, part of the base member 29 to which the light-emitting module 23 is mounted does not have to project significantly downward, so that increase in amount of material used for the base member 29 and increase in mass of the base member 29 can be inhibited. In addition, with the structure of the lamp unit 18, a large light shielding angle can be secured by the lamp unit 18 itself, and hence the lamp unit 18 having a narrow angle light distribution can be provided.

Also, since the heat conducting portion 40 of the base member 29 where the light-emitting module 23 is mounted is formed to be thicker than other portions of the base member 29, the heat capacity of the heat conducting portion 40 is large, and hence the heat of the light-emitting module 23 is efficiently conducted to the heat conducting portion 40, thereby improving the radiating performance.

Also, in the state in which the lamp unit 18 is mounted on the socket 16, the keys 45 are caught by the socket 16, and the lamp unit 18 is supported by the keys 45. Since the thickness of the heat conducting portion 40 of the base member 29 is large, if the keys 45 are provided on an upper side of the base member 29 for example, an upper side of the heat conducting portion 40 in the thickness direction is supported by the keys 45, and hence the distance from the positions of the keys 45 to the lower surface of the heat conducting portion 40 is increased, so that the moment is increased. In this embodiment, since the keys 45 are provided at positions closer to a lower side with respect to the position of the end surface 36 of the base member 29, that is, since the keys 45 are provided at an intermediate position of the heat conducting portion 40 in the thickness direction, the moment can be reduced, and hence the support of the lamp unit 18 is stabilized.

Also, since the case 28 is formed of the resin material, improvement of insulating properties of the lighting circuit 25 is achieved.

In addition, since the light-emitting module 23 is arranged at the upper position closer to the end surface 36 of the base member 29 with respect to the flat panel portion 31 of the case 28, the influence of heat generated by the light-emitting module 23 on the case 28 formed of the resin material can be alleviated.

Since the light-emitting module 23 and the lighting circuit 25 are separated by the light control unit 24, the influence of the heat generated by the light-emitting module 23 on the lighting circuit 25 can be alleviated, and the insulating properties between the light-emitting module 23 and the lighting circuit 25 can be improved.

By using the light control unit 24, light irradiated from the light-emitting portion 52 of the light-emitting module 23 can be emitted from the glove 26 without being shielded by the light-emitting module 23 or the like, so that lowering of light output can be prevented.

Since the lighting circuit board 64 formed with the opening 66 so as to oppose the light-emitting portion 52 of the light-emitting module 23 is used for the lighting circuit 25, the light radiated from the light-emitting portion 52 of the light-emitting module 23 can be prevented from being shielded by the lighting circuit board 64.

Also, among the lighting circuit components 65 to be mounted on the lighting circuit board 64, at least one of large components having a large projecting height from the lighting circuit board 64, heat generating components with high calorific value, and the components having a low tolerance for heat is mounted at outer positions of the lighting circuit board 64. Therefore, such an event that the large component shields light or the large component interferes with the light control unit 24 can be prevented, heat generated by the heat-generating components can easily be released to the peripheral surface portion 32 of the case 28 to inhibit the temperature rise of the heat-generating components. In addition, by positioning the components having a low tolerance for heat close to the peripheral surface portion 32 of the case 28 at a low temperature, the temperature rise of the components having a low tolerance for heat can be inhibited.

Also, since the light-emitting module 23 and the lighting circuit 25 are separated by the light control unit 24, and the components having a low tolerance for heat from among the lighting circuit components 65 are mounted at positions apart from the light control unit 24 on the lighting circuit board 64, the temperature rise of the components having a low tolerance for heat can be inhibited.

Since the annular lighting circuit board 64 includes components which may generate a noise such as a switching element mounted at positions away and opposite from the position of the power supply input portion in terms of the circumferential direction, noises from these components can be prevented from riding on the power supply line.

Since the lighting circuit 25 is provided with the lamp pins 67 so as to extend upright therefrom to the lighting circuit board 64, the wiring structure between the lighting circuit board 64 and the lamp pins 67 is simplified and, in addition, the lamp pins 67 can be built into the housing 21 together with the lighting circuit board 64, whereby assembleability is improved.

Since the base member 29 of the lamp unit 18 mounted on the socket 16 of the lighting fixture 11 comes into contact with and thermally connected to the contact surface 94 of the radiating member 17 via the heat conductive sheet 22, heat of the light-emitting module 23 can be conducted efficiently to the radiating member 17, so that the radiating performance can be improved.

Furthermore, when mounting the base 30 of the lamp unit 18 by pressing the same against the contact surface 94 of the radiating member 17 via the heat conductive sheet 22, the heat conductive sheet 22 comes into abutment with the contact surface 94 of the radiating member 17 and is resiliently deformed, and then is pressed against the interior of the depressed portion first. Then, the base 30 (that is, the restricting portion 43) comes into abutment with the contact surface 94 of the radiating member 17 and restricts further resilient deformation of the heat conductive sheet 22, so that the pressing force that the heat conductive sheet 22 is pressed against the contact surface 94 of the radiating member 17 is restricted from increasing. Therefore, the heat conductive sheet 22 can easily move with respect to the contact surface 94 of the radiating member 17, and the rotational operation of the lamp unit 18 is easily achieved and, in addition, excessive deformation of the heat conductive sheet 22 is prevented and damage of the heat conductive sheet 22 can be prevented.

In addition, since the metal foil 48 is provided on the surface of the heat conductive sheet 22, the heat conductive sheet 22 can move easily and smoothly with respect to the contact surface 94 of the radiating member 17 in comparison with the case where the silicone sheet 47 is in direct contact with the contact surface 94 of the radiating member 17 for example, so that the rotational operation of the lamp unit 18 can be facilitated. In addition, at the time of rotational operation of the lamp unit 18, the heat conductive sheet 22 can be prevented from separating from the base member 29 due to a frictional force with respect to the contact surface 94 of the radiating member 17.

Also, when mounting the base 30 of the lamp unit 18 by pressing the same against the lighting fixture 11 (the radiating member 17) side via the heat conductive sheet 22, the heat conductive sheet 22 comes into abutment with the lighting fixture 11 and is resiliently deformed, and then is pressed against the interior of the depressed portion 30*a* first. Then, the base 30 (the restricting portion 43) comes into abutment with the lighting fixture 11 side and restricts further resilient deformation of the heat conductive sheet 22, thereby restricting increase of the pressing force that the heat conductive sheet 22 is pressed against the lighting fixture 11 side. Therefore, excessive deformation of the heat conductive sheet 22 is prevented, the mounting operation on the basis of the rotation of the lamp unit 18 with respect to the lighting fixture 11 is facilitated, and damage of the heat conductive sheet 22 can be prevented.

In addition, since the restricting portion 43 is formed in the peripheral portion of the end surface 36, a peripheral portion of the heat conductive sheet 22 arranged in the depressed portion 30*a* can be positioned.

Figure 8:
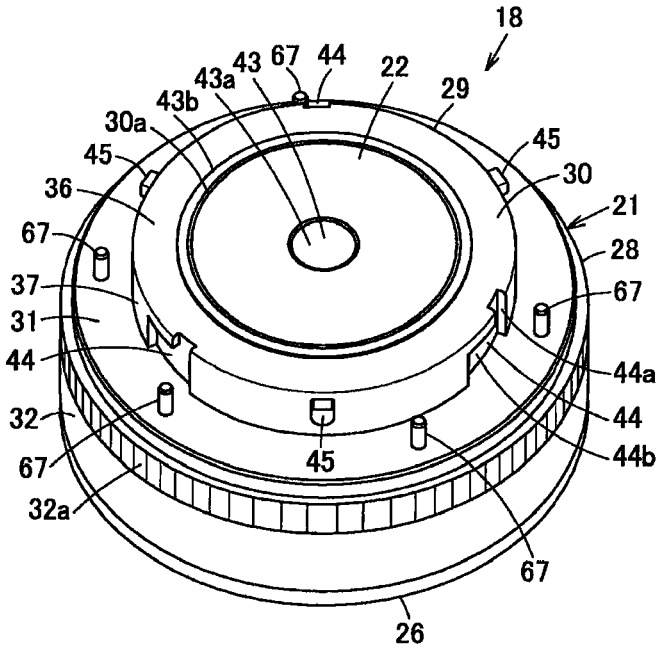
FIG. 8 is a perspective view of the other surface of a lamp unit according to a second embodiment.
Figure 9:
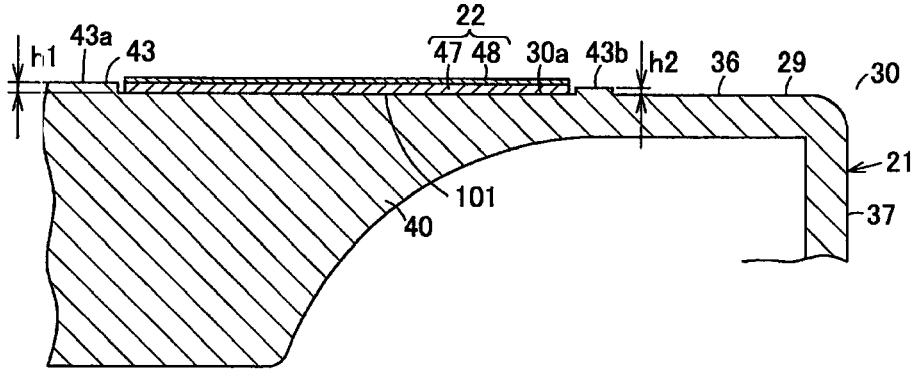
FIG. 9 is a cross-sectional view showing part of the lamp unit according to the second embodiment.

FIG. 8 and FIG. 9 show a second embodiment. The same configurations as in the first embodiment are designated by the same reference numerals and description thereof is omitted.

The restricting portion 43 formed so as to project from the end surface 36 of the base member 29 includes a central restricting portion 43*a* formed so as to project in a circular shape at a center of the base member 29 and a peripheral restricting portion 43*b* formed so as to project in an annular shape in a peripheral portion of the base member 29. The central restricting portion 43*a* and the peripheral restricting portion 43*b* are lower than the projecting dimension of the heat conductive sheet 22 from the end surface 36 of the base member 29 if the lamp unit 18 is not mounted on the lighting fixture 11 and no pressure is applied on the heat conductive sheet 22 and, in addition, a projecting height h1 of the central restricting portion 43*a* from the end surface 36 of the base member 29 is higher than a projecting height h2 of the peripheral restricting portion 43*b*. A depressed portion 101 shallower than the thickness of the heat conductive sheet 22 is formed in the end surface 36 of the base member 29.

The heat conductive sheet 22 is formed into an annular shape so as to be mounted in a depressed portion between the central restricting portion 43*a* and the peripheral restricting portion 43*b*.

Then, when mounting the base member 29 of the lamp unit 18 by pressing the same against the contact surface 94 of the radiating member 17 via the heat conductive sheet 22, the heat conductive sheet 22 is resiliently deformed by coming into abutment with the contact surface 94 of the radiating member 17, and then the central restricting portion 43*a* comes into abutment: with the contact surface 94 of the radiating member 17, whereby further resilient deformation of the heat conductive sheet 22 is restricted. If the lamp unit 18 is rotated in the mounting direction with the central restricting portion 43*a* in abutment with the contact surface 94 of the radiating member 17, the surface area of the contact surface 94 of the radiating member 17 where the central restricting portion 43*a* is in contact therewith is small, and the operator operates the peripheral portion of the case 28 or the glove 26 apart from the central restricting portion 43*a* radially outward by holding with his or her hand, the lamp unit 18 can be rotated with a light force.

The peripheral restricting portion 43*b* restricts the position of the heat conductive sheet 22 or, if the base member 29 of the lamp unit 18 is obliquely pressed against the contact surface 94 of the radiating member 17, the peripheral restricting portion 43*b* comes into abutment with the contact surface 94 of the radiating member 17 and restricts the resilient deformation of the heat conductive sheet 22.

The peripheral restricting portion 43*b* is not limited to have an annular shape, and may be formed discontinuously by being partly notched, or may be projections provided at a plurality of positions such as three, four, or five positions.

Figure 10:
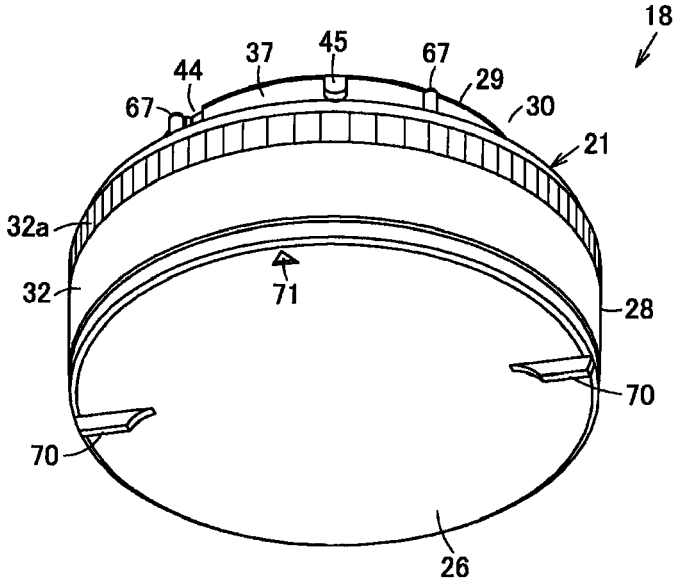
FIG. 10 is a perspective view of one surface of a lamp unit according to a third embodiment.

FIG. 10 shows a third embodiment. The same configurations as in the first embodiment are designated by the same reference numerals and description thereof is omitted.

A plurality of the finger placing portions 70 of the glove 26 may be formed into an elongated rib shape projecting from the surface of the glove 26 along the radial direction of the glove 26 instead of the plurality of projections in the embodiment describe above. The rib formed areas are included in areas opposing the cover portion 60 of the light control unit 24, and little affects the light distribution.

Then, by forming the plurality of the rib-shaped finger placing portions 70 on the glove 26, when mounting and demounting the lamp unit 18 with respect to the lighting fixture 11, the fingers can easily be caught by the plurality of the rib-shaped finger placing portions 70, so that the rotational operation of the lamp unit 18 can easily be performed.

In the embodiments described above, by forming the case 28 of metal and bringing the lighting circuit 25 into thermally contact with the case 28 by the heat conductive resin such as silicone resin, the temperature rise of the lighting circuit 25 may be inhibited by causing the heat of the lighting circuit 25 to be efficiently conducted and radiated to the case 28.

In addition, in the respective embodiments, the case 28 of the housing 21 and the base member 29 may be formed integrally of metal or resin superior in heat conductivity.

The heat conductive sheet 22 and the restricting portion 43 may be provided on the radiating member 17 side.

Alternatively, either one of the heat conductive sheet 22 and the restricting portion 43 (the depressed portion 30*a*) may be provided on the base member 29 of the lamp unit 18, and the other one of those may be provided on the radiating member 17. In addition, if the heat conductive sheet 22 is provided on the radiating member 17 side and if the heat conductive sheet 22 is provided with the metal foil 48, the metal foil 48 may be provided on the lamp side. Alternatively, if the heat conductive sheet 22 is provided on the lamp side and if the heat conductive sheet 22 is provided with the metal foil 48, the metal foil 48 may be provided on the radiating member 17. What is essential is that the heat conductive sheet 22 is interposed between the base 30 of the lamp unit 18 and the radiating member 17.

Since the heat conductive sheet 22 is interposed between the base 30 of the lamp unit 18 mounted on the socket 16 of the lighting fixture 11 and the radiating member 17 and is thermally joined, the heat of the light-emitting module 23 can be conducted efficiently to the radiating member 17, so that the radiating performance can be improved. When mounting the base 30 of the lamp unit 18 by pressing the same against the contact surface 94 of the radiating member 17 via the heat conductive sheet 22, the heat conductive sheet 22 is interposed between the base 30 and the radiating member 17 and is resiliently deformed. Since the restricting portion 43 is interposed between the base 30 and the radiating member 17, further resilient deformation of the heat conductive sheet 22 is restricted, and the pressing force that the heat conductive sheet 22 is pressed against the base 30 or the radiating member 17 is restricted from increasing, the rotational operation of the lamp unit 18 can be facilitated even if the heat conductive sheet 22 is interposed and, in addition, excessive deformation of the heat conductive sheet 22 is prevented, so that the damage of the heat conductive sheet 22 can be prevented.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lamp unit comprising:

a light-emitting module comprising a semiconductor light-emitting element;

a lighting circuit configured to cause the semiconductor light-emitting element to light; and a housing comprising:

a case opening in a direction of radiation of light, the case including a flat panel portion formed with a through-hole at a center of the flat panel portion on a side of the case opposite from a direction of radiation of light from the semiconductor light emitting element, and a base provided on the flat panel portion on a side opposite from the direction of radiation of the light from the semiconductor light emitting element, the lighting circuit arranged relative to the flat panel portion in a direction corresponding to the direction of radiation of light from the semiconductor light emitting element, and the light-emitting module mounted on the base on the side opposite from the direction of radiation of the light from the semiconductor light emitting element and aligned with the through-hole.

2. The unit according to claim 1, wherein the base is provided with a heat conducting portion on which the light-emitting module is mounted, and the heat conducting portion is formed to be thicker than other portions of the base and projects toward the direction of radiation of light from the semiconductor light emitting element.

3. The unit according to claim 2, comprising a socket mounting portion provided in the periphery of the base at a position closer to the case with respect to the position of an end surface of the base.

4. The unit according to claim 1, wherein the case is formed of a resin material.

5. The unit according to claim 1, comprising a light control unit having a cylindrical form and configured to separate the light-emitting module and the lighting circuit, wherein one end of the light control unit penetrates the through hole.

6. The unit according to claim 1, wherein the lighting circuit includes:

a lighting circuit board in which an opening is formed, the opening allowing passage of light emitted from the light-emitting element therethrough and aligned with the through-hole; and lighting circuit components mounted on the lighting circuit board.

7. The unit according to claim 6, wherein the lighting circuit components comprise large components having a large projecting height from the lighting circuit board, heat generating components with high calorific values, and components having a low tolerance for heat, wherein at least one of the large components, the heat generating components, and/or the components having a low tolerance for heat is mounted at outer positions of the lighting circuit board.

8. The unit according to claim 6, comprising a light control unit configured to separate the light-emitting module and the lighting circuit, wherein the lighting circuit components comprise a component having a low tolerance for heat mounted at a position apart from the light control unit on the lighting circuit board.

9. The unit according to claim 6, wherein the lighting, circuit includes lamp pins provided on the lighting circuit board and projecting from the flat panel portion of the housing.

10. A lighting fixture comprising:

the lamp unit according to claim 1;

a socket having the lamp unit mounted thereon; and a radiating member configured to contact of the base of the lamp unit.

* * * * *